US010508557B2

(12) United States Patent
Jung

(10) Patent No.: US 10,508,557 B2
(45) Date of Patent: Dec. 17, 2019

(54) GAS TURBINE

(71) Applicant: DOOSAN HEAVY INDUSTRIES & CONSTRUCTION CO., LTD, Changwon-si, Gyeongsangnam-do (KR)

(72) Inventor: Sung Chul Jung, Daejeon (KR)

(73) Assignee: Doosan Heavy Industries Construction Co., Ltd., Gyeongsangnam-do (KR)

( * ) Notice: Subject to any disclaimer, the term of this patent is extended or adjusted under 35 U.S.C. 154(b) by 123 days.

(21) Appl. No.: 15/844,161

(22) Filed: Dec. 15, 2017

(65) Prior Publication Data

US 2018/0179904 A1 Jun. 28, 2018

(30) Foreign Application Priority Data

Dec. 23, 2016 (KR) ..... 10-2016-0178066

(51) Int. Cl.

| | |
|---|---|
| ***F01D 5/32*** | (2006.01) |
| ***F01D 5/30*** | (2006.01) |
| *F01D 5/02* | (2006.01) |
| *F01D 5/12* | (2006.01) |

(52) U.S. Cl.

CPC ..... *F01D 5/326* (2013.01); *F01D 5/3007* (2013.01); *F01D 5/3015* (2013.01); *F01D 5/02* (2013.01); *F01D 5/12* (2013.01); *F05D 2220/32* (2013.01); *F05D 2260/30* (2013.01)

(58) Field of Classification Search

None

See application file for complete search history.

(56) References Cited

U.S. PATENT DOCUMENTS 2,755,063 A * 7/1956 Wilkinson ..... F01D 5/3015 192/105 BA
3,656,865 A * 4/1972 Spears, Jr. ..... F01D 5/3015 416/220 R
3,841,794 A * 10/1974 Bergmann ..... F01D 5/326 416/221
3,853,425 A * 12/1974 Scalzo ..... F01D 5/18 416/193 A
4,033,705 A * 7/1977 Luebering ..... F01D 5/3015 416/220 R (Continued)

FOREIGN PATENT DOCUMENTS

JP 2010216474 A 9/2010
JP 4733709 B2 7/2011
JP 5414200 B2 2/2014

OTHER PUBLICATIONS

A Korean Office Action issued by the Korean Intellectual Property Office dated Jan. 2, 2018 in connection with Korean patent application No. 10-2016-0178066.

*Primary Examiner* — Michael Lebentritt

(74) *Attorney, Agent, or Firm* — INVENSTONE Patent, LLC

(57) ABSTRACT

A gas turbine includes protrusions provided on perimeters of front and rear surfaces of the turbine disk, a first retainer unit having openings at positions corresponding to the respective protrusions provided on the front surface of the turbine disk, and a second retainer unit having a first end thereof disposed in a first insert slot of the turbine disk and a second end thereof disposed in the second insert slot of turbine blades to fix the plurality of turbine blades to the turbine disk.

18 Claims, 6 Drawing Sheets

(56) References Cited

U.S. PATENT DOCUMENTS 4,171,930 A * 10/1979 Brisken ..... F01D 5/3015 416/193 A
4,265,595 A * 5/1981 Bucy, Jr. ..... F01D 5/3007 416/220 R
4,648,799 A * 3/1987 Brown ..... F01D 5/3015 416/220 R
4,767,276 A * 8/1988 Barnes ..... F01D 5/3015 416/220 R
4,854,821 A * 8/1989 Kernon ..... F01D 5/3015 416/95
5,281,098 A * 1/1994 Glynn ..... F01D 5/3015 416/220 R
5,302,086 A * 4/1994 Kulesa ..... F01D 5/3007 416/220 R
5,380,157 A * 1/1995 Shaffer ..... F01D 5/3023 416/220 A
5,622,475 A * 4/1997 Hayner ..... F01D 5/3015 416/219 R
5,639,216 A * 6/1997 McLaurin ..... F01D 5/187 416/95
5,746,578 A * 5/1998 Brassfield ..... F01D 5/22 416/190
7,264,447 B2 * 9/2007 Ono ..... F01D 5/3015 416/193 A
8,696,320 B2 * 4/2014 Harris, Jr. ..... F01D 5/26 416/244 R
9,689,278 B2 * 6/2017 Adenis ..... F01D 25/243
2005/0111976 A1 * 5/2005 Lee ..... F01D 5/081 416/97 R
2008/0181767 A1 * 7/2008 Brillert ..... F01D 5/081 415/170.1
2009/0053065 A1 * 2/2009 Oka ..... F01D 5/3007 416/220 R
2009/0136356 A1 * 5/2009 Beckford ..... F01D 5/3007 416/239
2013/0004319 A1 * 1/2013 Lee ..... F01D 5/3015 416/219 R
2013/0202433 A1 * 8/2013 Hafner ..... F01D 5/3015 415/230
2017/0002674 A1 * 1/2017 Vetters ..... F01D 25/246
2018/0128110 A1 * 5/2018 Sippel ..... F01D 5/08
2018/0298766 A1 * 10/2018 Jung ..... F01D 5/3007
2019/0078439 A1 * 3/2019 Jang ..... F01D 5/081

* cited by examiner

GAS TURBINE

CROSS-REFERENCE TO RELATED APPLICATION(S)

This application claims priority to Korean Patent Application No. 10-2016-0178066, filed on Dec. 23, 2016 the disclosure of which is incorporated herein by reference in its entirety.

BACKGROUND

Exemplary embodiments of the present disclosure relate to a retainer provided to stably fix turbine blades inserted into respective dovetail grooves of a turbine disk, and more particularly, to a gas turbine having a structure improved to facilitate inspection or repair of a plurality of turbine blades.

In general, an engine or an apparatus including a turbine, such as a gas turbine or a steam turbine, is called a turbo machine. The turbo machine is a power generator which converts thermal energy of fluid into rotational force, which is a type of mechanical energy. The turbo machine includes a rotor which is axially rotated by fluid, and a stator which supports and encloses the rotor.

The gas turbine may be a kind of internal combustion engine, including a turbine which converts thermal energy into mechanical energy by expanding high-temperature and high-pressure combustion gas generated by combusting a mixture of fuel with air compressed to a high pressure by a compressor. Each of the compressor and the turbine obtains rotational force from a rotor unit.

In order to form the rotor unit of the compressor or the turbine, the gas turbine includes a plurality of compressor rotor disks each of which includes a plurality of compressor blades arranged around an outer circumferential surface thereof. A tie bolt is provided to couple the rotor disks with each other and enable them to integrally rotate and to couple a plurality of turbine rotor disks with each other so that the turbine rotor disks each having an outer circumferential surface around which a plurality turbine blades are arranged can be integrally rotated. The tie bolt has a well-known configuration in which it extends through a central portion of the rotor disk of the compressor and a central portion of the rotor disk of the turbine and couples the rotor disk of the compressor with the rotor disk of the turbine.

Blades to be mounted to the rotor disk are primarily inserted into respective dovetail grooves and then fixed to front and rear portions of the dovetails by retainers. The conventional retainer functions to simply fix a blade in place, but must function as a cooling air seal for cooling blades disposed at positions corresponding to first to third stages. Furthermore, in the conventional gas turbine, when it is necessary to repair the blades, there is required a complex process including disassembling a plurality of casings enclosing the rotor, separating the blades from the dovetail grooves using separate equipment in a work site, and reassembling the parts. Furthermore, because it is not easy for a worker to remove the retainer from the blades, measures for solving this problem are required.

SUMMARY

An object of the present disclosure is to provide a gas turbine in which retainers are allowed to be easily assembled with or disassembled from front and rear surfaces of turbine blades so that inspection or replacement of turbine blades can be facilitated without disassembling a turbine rotor.

Other objects and advantages of the present disclosure can be understood by the following description, and become apparent with reference to the embodiments of the present disclosure. Also, those skilled in the art to which the present disclosure pertains would appreciate that the objects and advantages of the present disclosure can be realized by the means as claimed and combinations thereof.

In accordance with one aspect, a gas turbine includes a turbine disk provided in a turbine and including a turbine disk body, with protrusions provided on perimeters of front and rear surfaces of the turbine disk body, and a first insert slot formed in the rear surface of the turbine disk body in a circumferential direction, a first retainer unit having openings at positions corresponding to the respective protrusions to fix a plurality of turbine blades to the turbine disk at the front surface of the turbine disk, the plurality of turbine blades being inserted into respective dovetail grooves formed in a circumferential surface of the turbine disk body and each having a second insert slot in a surface of the turbine blade that faces the first insert slot, a second retainer unit inserted at a first end thereof into the first insert slot and inserted at a second end thereof into the second insert slot to fix the plurality of turbine blades to the turbine disk at the rear surface of the turbine disk, and a fixing unit provided for fixing of the first and second retainers.

The protrusions may include first protrusions protruding outward on the perimeter of the front surface of the turbine disk along a concentric circle centered on a center of the turbine disk, and second protrusions protruding outward on the perimeter of the rear surface of the turbine disk along a concentric circle centered on the center of the turbine disk.

The first retainer unit may include a plurality of unit retainers disposed in close contact with each other in a circumferential direction along a concentric circle centered on a center of the turbine disk.

The unit retainers may extend the same length.

Each of the unit retainers may include a first locking part formed on a first end of the unit retainer and closely locked to a disk protrusion protruding outward along the perimeter of the front surface of the turbine disk, and a second end of the unit retainer comes into close contact with a front surface of the corresponding turbine blade.

Each of the openings may have a size corresponding to each of the protrusions.

Each of the unit retainers may have either an arc shape or a semi-circular shape, and when a plurality of unit retainers come into close contact with each other, the unit retainers may be assembled with each other in a ring shape.

The unit retainers may come into close contact with front surfaces of the turbine blades on the front surface of the turbine disk.

The second retainer unit may include a plurality of unit retainers disposed in a circumferential direction along a concentric circle centered on the center of the turbine disk, and each of the unit retainers may include a second retainer body having a plate shape, and fitting depressions formed in left and right sides of the second retainer body at positions facing away from each other and fitted over the corresponding second protrusions.

Each of the fitting depressions may extend a length corresponding to half of a width of the second protrusion.

The second retainer body may include a first stepped part formed at a left side edge of the second retainer body at which one of the fitting depressions is formed, and a second stepped part formed at a right side edge of the second retainer body at which the other fitting depression is formed.

The second retainer body may have a predetermined thickness such that the second protrusion protrudes further than the second retainer body.

The fixing unit may include a first fixing member disposed on a front surface of the unit retainer of the first retainer unit and fitted over the corresponding protrusion to assist in fixing the unit retainer, and a second fixing member disposed on a rear surface of the unit retainer of the second retainer unit and fitted over the corresponding protrusion to assist in fixing the unit retainer.

The first fixing member may include a second locking part coming into close contact with left and right side surfaces of the corresponding protrusion and locked to an upper surface of the protrusion. The second fixing member may include a third locking part coming into close contact with left and right side surfaces of the corresponding protrusion and locked to an upper surface of the protrusion.

It is to be understood that both the foregoing general description and the following detailed description of the present disclosure are exemplary and explanatory and are intended to provide further explanation of the invention as claimed.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
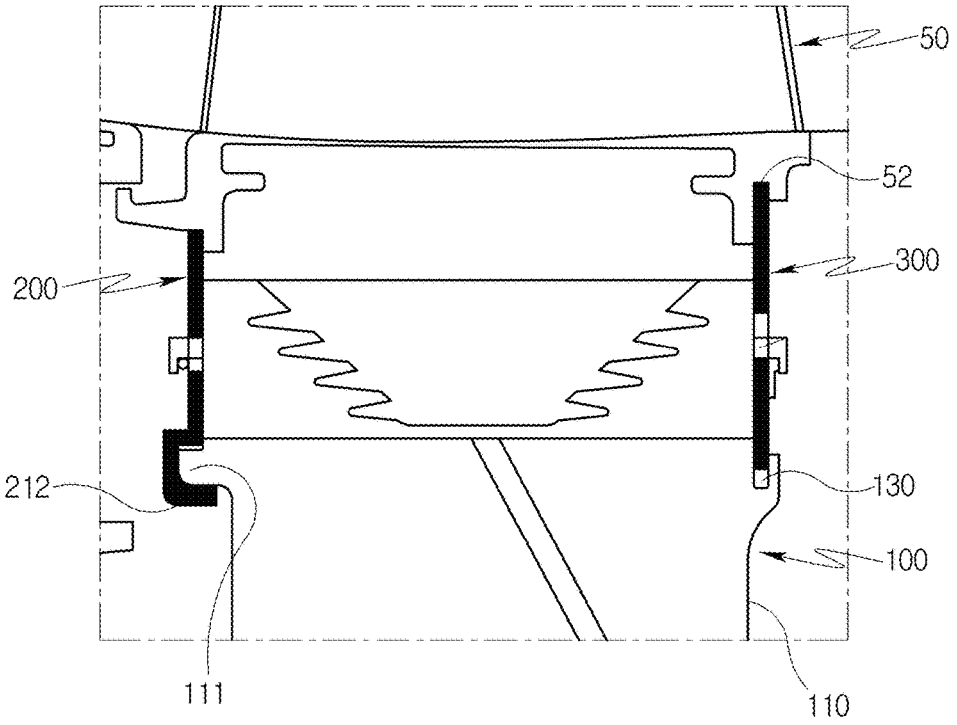
FIG. 1 is a view illustrating a turbine blade of a turbine disk provided in a gas turbine, and a retainer configured to fix the turbine blade according to an exemplary embodiment.
Figure 2:
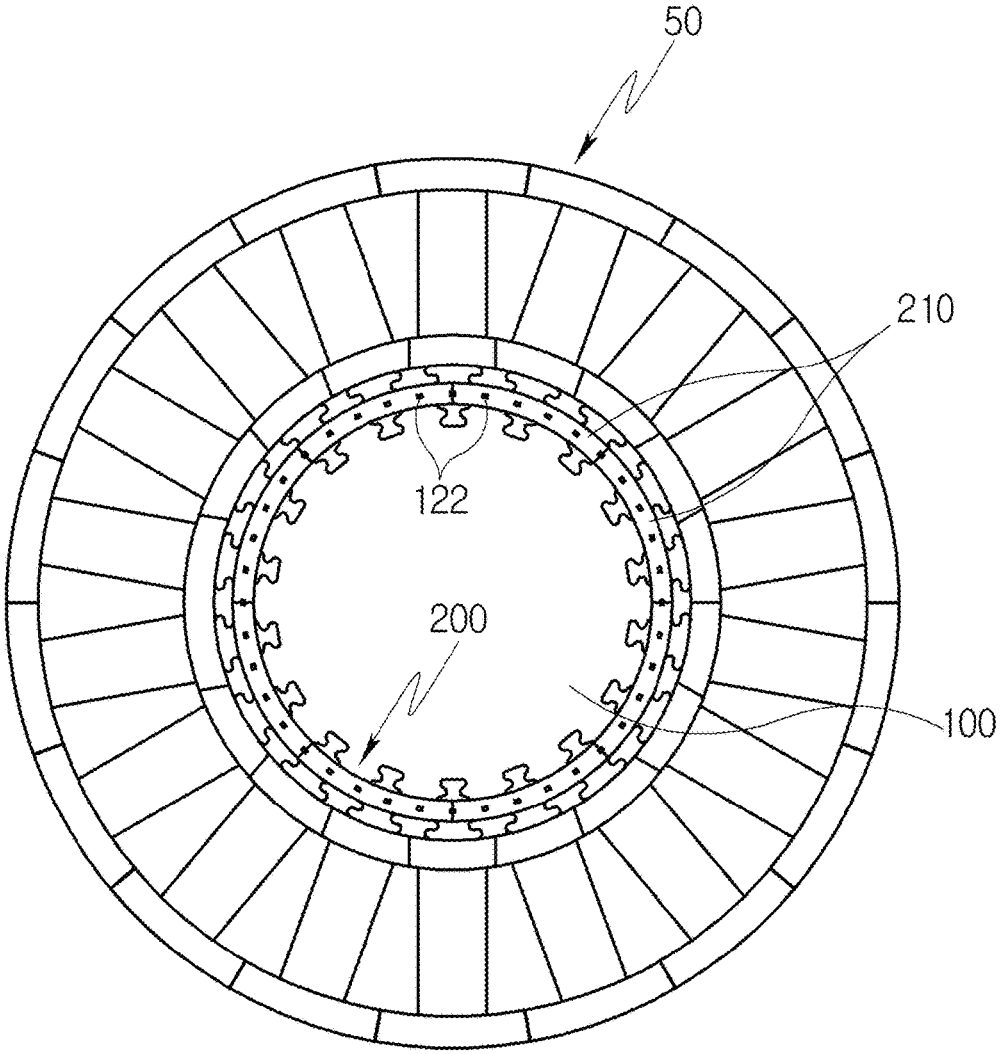
FIG. 2 is a view illustrating a first retainer unit configured to fix the turbine blade coupled to the turbine disk according to an exemplary embodiment.
Figure 3:
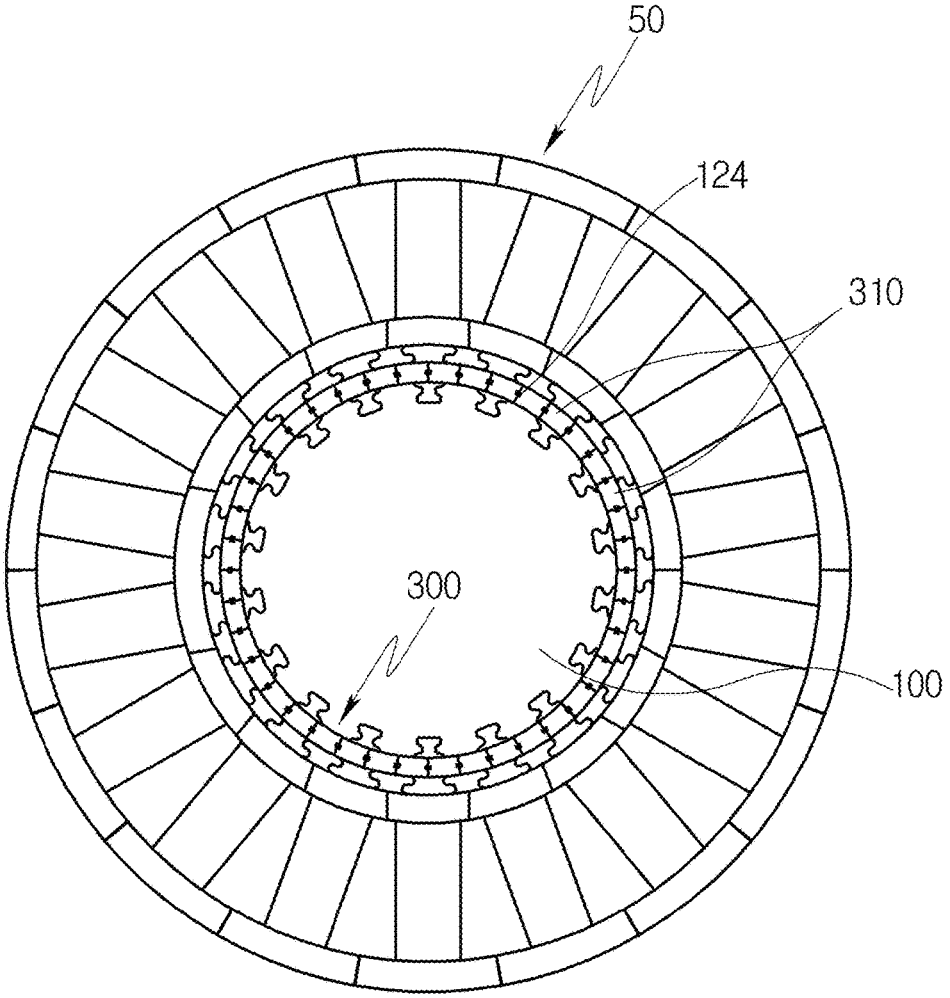
FIG. 3 is a view illustrating a second retainer unit configured to fix the turbine blade coupled to the turbine disk according to an exemplary embodiment.
Figure 4:
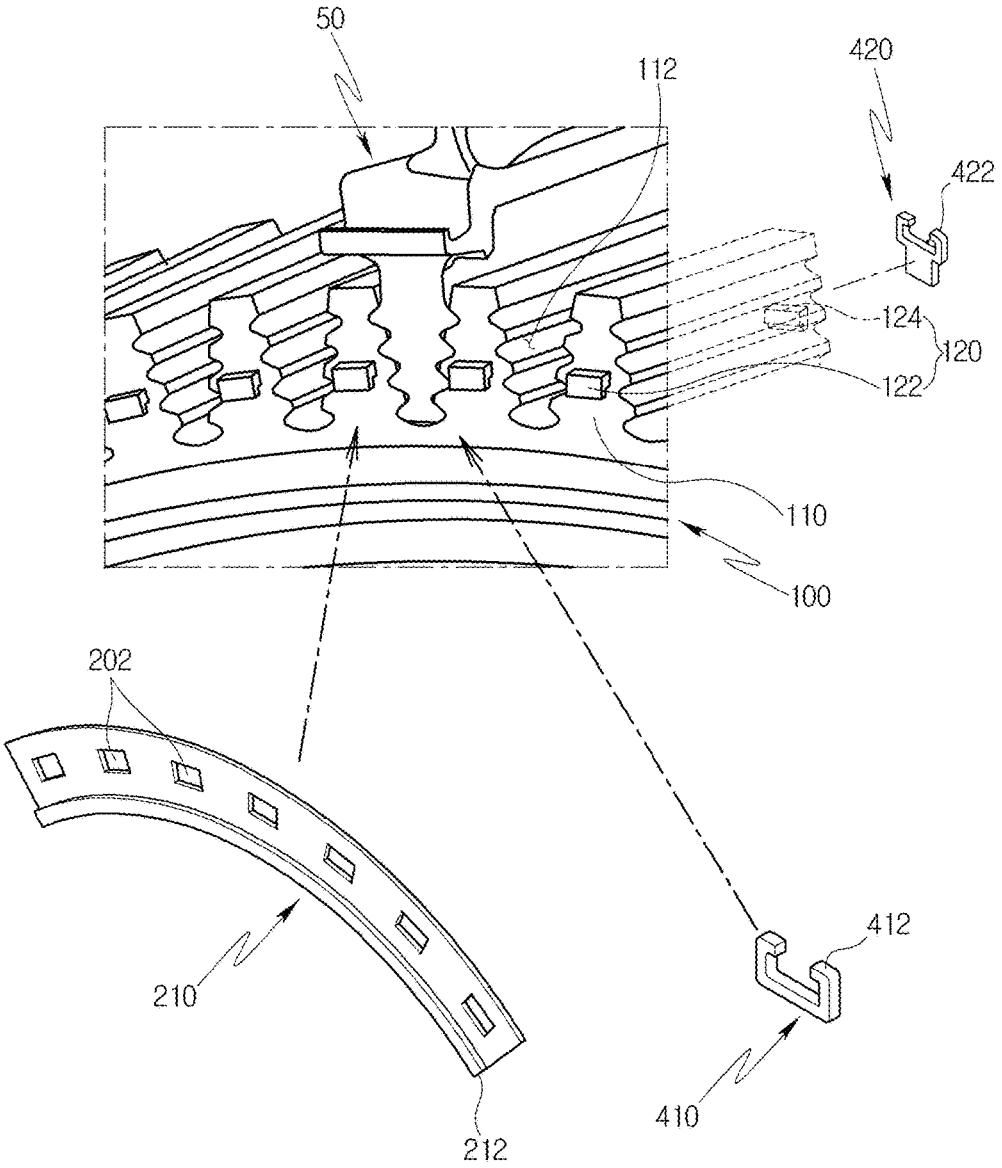
FIG. 4 is a perspective view illustrating an exemplary embodiment of the first retainer unit configured to fix the turbine blade coupled to the turbine disk.

Hereinafter, a gas turbine according to an embodiment of the present disclosure will be described with reference to the attached drawings. FIG. 1 is a view illustrating a turbine blade 50 of a turbine disk 100 provided in a gas turbine, and a retainer configured to fix the turbine blade 50 according to an exemplary embodiment. FIG. 2 is a view illustrating a first retainer unit 200 configured to fix the turbine blade 50 coupled to the turbine disk 100 according to an exemplary embodiment. FIG. 3 is a view illustrating a second retainer unit 300 configured to fix the turbine blade 50 coupled to the turbine disk 100 according to an exemplary embodiment. FIG. 4 is a perspective view illustrating the first retainer unit 200 configured to fix the turbine blade 50 coupled to the turbine disk 100.

Referring to FIGS. 1 to 4, the present exemplary embodiment relates to a retainer that is provided in the gas turbine and comes into close contact with each of the front and rear surfaces of the turbine disk 100 after a plurality of turbine blades 50 have been inserted into respective dovetail grooves 112 (refer to FIG. 4). In the turbine disk 100, the dovetail grooves 112 are formed in a circumferential surface of a turbine disk body 110, and the turbine blades 50 are inserted into the respective dovetail grooves 112. To prevent thermal expansion due to heated gas, the turbine blade 50 may have a separate cooling flow passage (not shown) therein. A plurality of ribs is disposed at regular intervals in the cooling flow passage so as to secure smooth movement of cooling air flowing along the cooling flow passage and assist in enhancing heat transfer efficiency of the turbine blades 50.

The turbine blades 50 are inserted into the respective dovetail grooves 112 for cooling and fixing the turbine blades 50. Here, a retainer is used to fix the turbine blades 50 to the dovetail grooves 112 so that the turbine blades 50 can more stably remain fixed in the dovetail grooves 112. For example, a retainer according to an exemplary embodiment includes a first retainer unit 200 provided on front surfaces of the turbine blades 50 shown in FIG. 4, and a second retainer unit 300 provided on rear surfaces of the turbine blades 50, thus making it possible for the turbine blades 50 to remain stably fixed on the front and rear surfaces thereof.

In the turbine disk 100 according to the present exemplary embodiment, protrusions 120 (refer to FIG. 4) are provided on perimeters of the front and rear surfaces of the turbine disk body 110. A first insert slot 130 (refer to FIG. 1) is formed in the rear surface of the turbine disk body 110 in a circumferential direction.

First protrusions 122 of the protrusions 120 are provided for insertion of the first retainer unit 200, and the first insert slot 130 is provided for insertion of the second retainer unit 300. The protrusions 120 includes the first protrusions 122 which protrude outwardly from the perimeter of the front surface of the turbine disk 100 along a concentric circle centered on the center of the turbine disk 100, and second protrusions 124 which protrude outwardly from the perimeter of the rear surface of the turbine disk 100 along a concentric circle centered on the center of the turbine disk 100. Each of the first and second protrusions 122 and 124 is configured to be brought into contact with a corresponding fixing member 410 or 420, respectively, which will be described later herein, and the configuration thereof may be changed without being limited thereto.

A second insert slot 52 (refer to FIG. 1) is formed in a surface facing the first insert slot 130 so that the second retainer unit 300 can be closely installed on the rear surface of the turbine disk 100.

The first retainer unit 200 includes a plurality of unit retainers 210 which are disposed in close contact with each other in a circumferential direction along a concentric circle centered on the center of the turbine disk 100. Each of the plurality of unit retainers 210 has openings 202, and the first protrusions 122 provided on the first surface of the turbine disk 100 are inserted into the respective openings 202. First fixing members 410 are coupled to the first protrusions 122 that protrude out of the front surface of the first retainer unit 200, whereby the first retainer unit 200 can be stably fixed.

Each of the unit retainers 210 may extend the same length, and the number of unit retainers 210 may be as described in the drawings. Each unit retainer 210 may have any one of an arc shape or a semi-circular shape. When the retainers 210 are coupled with each other, they form a ring shape.

It is preferable that each of the unit retainers 210 extends the same length. The reason for this is because the above-mentioned configuration makes it possible to stably install the plurality of turbine blades in the circumferential direction of the turbine disk 100.

The unit retainers 210 come into close contact with the front surfaces of the turbine blades 50 on the front surface of the turbine disk 100. For instance, in the case where the turbine blade 50 is disposed at first to third stages, it is important to prevent leakage of cooling air in order to reliably cool the turbine blade 50.

In the turbine disk 100 according to the present disclosure, to prevent the cooling efficiency of a disk disposed at a certain stage from being reduced, the plurality of unit retainers 210 are brought into close contact with each other on the front surface of the turbine blade 50. In this case, the unit retainers 210 are not spaced apart from each other, and a separate space is not formed therebetween, whereby the close contact force therebetween can be further enhanced.

In addition, the first retainer unit 200 can prevent cooling air from leaking from the front surface of the turbine blade 50, thus securing satisfactory cooling efficiency of the turbine blade 50, thereby preventing thermal deformation of the turbine blade 50 due to gas heated to a high temperature, and promoting reliable cooling.

Each of the unit retainers 210 has, on a first end thereof corresponding to a lower portion based on the front surface, a first locking part 212 which is brought into close contact with and is locked to a disk protrusion 111 that protrudes outward along the perimeter of the front surface of the turbine disk 100. A second end of the unit retainer 210 comes into close contact with the front surface of the turbine blade 50.

The unit retainer 210 is installed on the turbine disk 100 in such a way that the first locking part 212 is closely locked to the disk protrusion 111 and then the second end of the unit retainer 210 remains in close contact with the front surface of the turbine blade 50. Thereafter, the installation of the unit retainer 210 is completed by stably fixing it using the first fixing member 410, which will be described later herein.

The unit retainer 210 has the openings 202 arranged in the circumferential direction. The openings 202 are located at positions corresponding to the associated protrusions 122 and each have a size corresponding to the protrusion 122. In this case, because the protrusions 122 are fitted into the respective openings 202 and, in addition, the first locking part 212 is locked to the disk protrusion 111, the unit retainer 210 can stably remain coupled to the turbine disk body 110.

Figure 5:
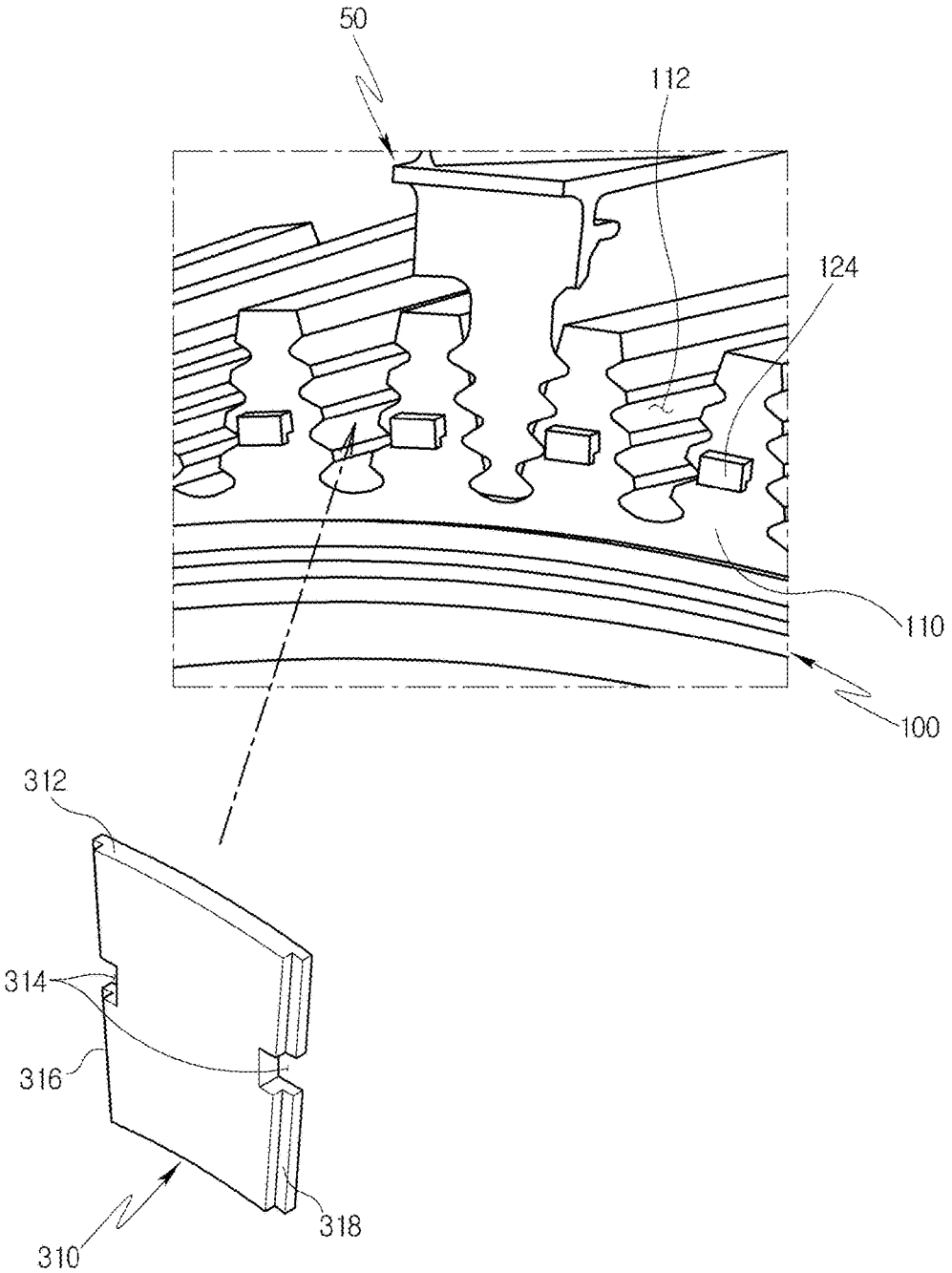
FIG. 5 is a perspective view illustrating an exemplary embodiment of the second retainer unit configured to fix the turbine blade coupled to the turbine disk.
Figure 7:
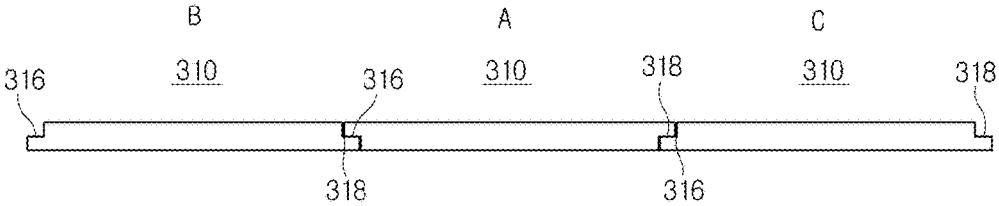
FIG. 7 is a view illustrating a unit retainer installed on a rear surface of the turbine blade according to an exemplary embodiment.

Referring to FIGS. 1, 5 and 7, the second retainer unit 300 according to the present exemplary embodiment is inserted at a first end thereof into the first insert slot 130 and inserted at a second end thereof into the second insert slot 52 so that the turbine blades 50 can be fixed to the rear surface of the turbine disk 100.

The second retainer unit 300 includes a plurality of unit retainers 310. Each unit retainer 310 has a plate shape. The unit retainers 310 engage with each other along a concentric circle centered on the center of the turbine disk 100.

Each of the unit retainers 310 includes a second retainer body 312 having a plate shape, and fitting depressions 314 which are formed in respective left and right side edges of the second retainer body 312 at positions facing away from each other and are fitted over the corresponding second protrusions 124.

The second retainer body 312 has a plate shape in which a vertical length thereof is greater than a horizontal length. The fitting depressions 314 are located at positions facing away from each other, and each fitting depression 314 extends a length corresponding to half of the width of the second protrusion 124.

Each of the unit retainers 310 are closely assembled with each other on the rear surface of the turbine disk 100. Given this, each unit retainer 310 includes a first stepped part 316 formed at a left side at which one of the fitting depressions 314 is formed, and a second stepped part 318 formed at a right side at which the other fitting depression 314 is formed.

The first and second stepped parts 316 and 318 have the same structure on the left and right sides of the second retainer body 312. When the unit retainers 310 are assembled with each other, each unit retainer 310 engages with the first stepped part 316 of another unit retainer 310 that is adjacent to the second stepped part 318 thereof, and each unit retainer 310 engages with the second stepped part 318 of another unit retainer 310 that is adjacent to the first stepped part 316 thereof.

In this case, each unit retainer 310 engages with other adjacent unit retainers 310 at left and right sides based on reference position A (refer to FIG. 7). The unit retainers 310 that are disposed at positions B and C are oriented toward the rear surface of the turbine disk 100 rather than being oriented in a direction in which the unit retainer 310 disposed at position A is oriented. Furthermore, other unit retainers (not shown) that engage with the unit retainers 310 disposed at positions B and C are oriented in the same direction as that of the unit retainer 310 disposed at position A.

In other words, based on the unit retainer 310 disposed at position A, other retainers are coupled to each other in such a way that front and rear surfaces thereof alternate with each other. If the unit retainers 310 engage with each other in the above-described manner, they can come into close contact with each other in a surface-to-surface manner, whereby the coupling stability thereof can be enhanced.

The thickness of the second retainer body 312 is less than that of the second protrusion 124. The second retainer body 312 is fixed by a second fixing member 420. Taking into account the thickness of the second fixing member 420, the second retainer body 312 has a thickness such that it does not protrude further than the second protrusion 124.

Figure 6:
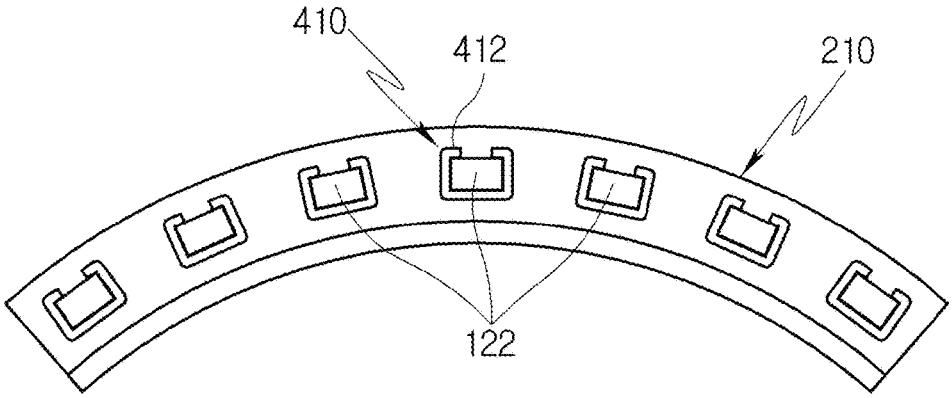
FIG. 6 is a view illustrating a unit retainer installed on a front surface of the turbine blade according to an exemplary embodiment.
Figure 8:
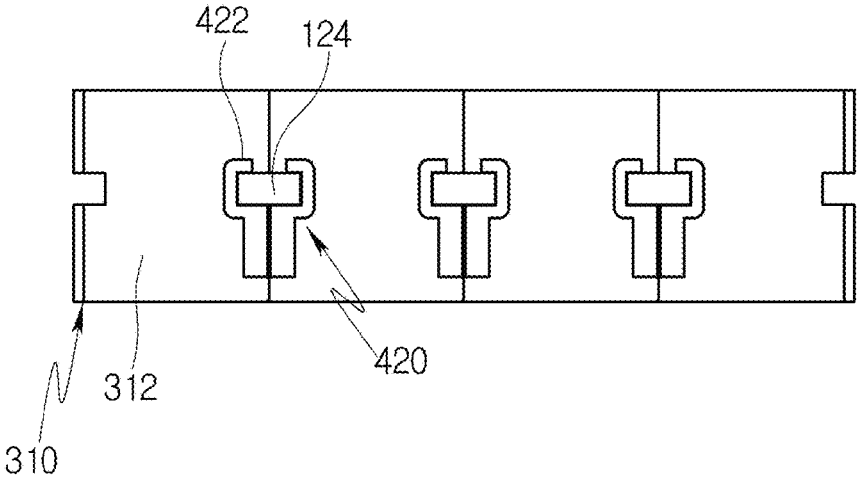
FIG. 8 is a front view of FIG. 7.

Referring to FIGS. 6 and 8, the present exemplary embodiment includes the first and second fixing members 410 and 420 provided for fixing the first and second retainers 200 and 300, respectively.

The first fixing member 122 is disposed on the front surface of the unit retainer 210 of the first retainer unit 200 and fitted over the first protrusion 122 to fix the unit retainer 210 in place. The second fixing member 420 is disposed on the rear surface of the unit retainer 310 of the second retainer unit 300 and fixed over the second protrusion 124 to fix the unit retainer 310 in place.

The first fixing member 410 is open on an upper portion thereof and is brought into close contact with left and right side surfaces of the first protrusion 122. The first fixing member 410 includes a second locking part 412 which is locked to an upper surface of the first protrusion 122. In the present exemplary embodiment, the first fixing members 410 are coupled to the respective first protrusions 122. Hence, the unit retainer 210 can reliably remain in close contact with the front surface of the turbine disk 100, the close contact force therebetween can be enhanced, and leakage of cooling air supplied to the turbine blade 50 can be prevented.

The second fixing member 420 comes into close contact with left and right side surfaces of the second protrusion part 124 and further includes a third locking part 422 which is locked to an upper surface of the second protrusion 124. The third locking part 422 has a structure similar to that of the second locking part 412 and is installed in surface contact with the corresponding unit retainers 310 that come into close contact with each other.

Therefore, the turbine blades 50 can be stably fixed by the first and second fixing members 410 and 420, at initial positions at which the turbine blades 50 are inserted into the respective dovetail grooves 112 on the front and rear surfaces of the turbine disk 100.

Various embodiments of the present disclosure enable a worker to easily perform an operation of assembling or disassembling a turbine blade with or from a rotor to replace it with a new one or inspect it in a site.

In accordance with embodiments of the present disclosure, the turbine blade can be reliably fixed in place and sealed, whereby leakage of cooling air can be minimized In embodiments of the present disclosure, a plurality of turbine blades can be stably fixed, so that the fixing stability can be enhanced.

While the present disclosure has been described with respect to the specific exemplary embodiments, it will be apparent to those skilled in the art that various changes and modifications may be made without departing from the spirit and scope of the disclosure as defined in the following claims.

What is claimed is:

1. A gas turbine comprising:

a turbine disk including a turbine disk body, dovetail grooves formed in a circumferential surface of the turbine disk body, protrusions provided on perimeters of front and rear surfaces of the turbine disk body, and a first insert slot formed in the rear surface of the turbine disk body in a circumferential direction;

a first retainer unit having openings at positions corresponding to the respective protrusions provided on the front surface of the turbine disk to fix a plurality of turbine blades to the turbine disk, the plurality of turbine blades disposed in the respective dovetail grooves of the turbine disk body and each having a second insert slot in a surface of the turbine blade that faces the first insert slot;

a second retainer unit having a first end thereof disposed in the first insert slot and a second end thereof disposed in the second insert slot to fix the plurality of turbine blades to the turbine disk at the rear surface of the turbine disk; and a plurality of fixing members provided to fix the first and second retainer units, wherein the second retainer unit comprises a plurality of second unit retainers disposed in a circumferential direction along a concentric circle centered on the center of the turbine disk, and each of the second unit retainers comprises:

a second retainer body having a plate shape; and fitting depressions formed in left and right sides of the second retainer body at positions facing away from each other and fitted over the corresponding respective protrusions provided on the rear surface of the turbine disk.

2. The gas turbine according to claim 1, wherein the protrusions comprise:

first protrusions protruding outwardly on the perimeter of the front surface of the turbine disk along a concentric circle centered on a center of the turbine disk; and second protrusions protruding outwardly on the perimeter of the rear surface of the turbine disk along a concentric circle centered on the center of the turbine disk.

3. The gas turbine according to claim 1, wherein the first retainer unit comprises a plurality of first unit retainers disposed in close contact with each other in a circumferential direction along a concentric circle centered on a center of the turbine disk.

4. The gas turbine according to claim 3, wherein each of the first unit retainers have the same length.

5. The gas turbine according to claim 3, wherein each of the first unit retainers comprises a first locking part formed on a first end of the first unit retainer to be closely locked to a disk protrusion protruding outward along the perimeter of the front surface of the turbine disk, and a second end of the first unit retainer to come in close contact with a front surface of the corresponding turbine blade.

6. The gas turbine according to claim 5, wherein each of the openings has a size corresponding to each of the protrusions.

7. The gas turbine according to claim 3, wherein each of the first unit retainers has either an arc shape or a semicircular shape, and when a plurality of the first unit retainers come into close contact with each other, the first unit retainers assembled form a ring shape.

8. The gas turbine according to claim 7, wherein the first unit retainers come into close contact with front surfaces of the turbine blades on the front surface of the turbine disk.

9. The gas turbine according to claim 1, wherein each of the fitting depressions extends a length corresponding to half of a width of the respective protrusions provided on the rear surface of the turbine disk.

10. The gas turbine according to claim 1, wherein the second retainer body comprises:

a first stepped part formed at a left side edge of the second retainer body at which one of the fitting depressions is formed; and a second stepped part formed at a right side edge of the second retainer body at which the other fitting depression is formed.

11. The gas turbine according to claim 1, wherein the second retainer body has a predetermined thickness such that the respective protrusion protrudes further than the second retainer body when the second retainer body is fitted over the corresponding protrusion.

12. A gas turbine comprising:

a turbine disk including a turbine disk body, dovetail grooves formed in a circumferential surface of the turbine disk body, protrusions provided on perimeters of front and rear surfaces of the turbine disk body, and a first insert slot formed in the rear surface of the turbine disk body in a circumferential direction;

a first retainer unit having openings at positions corresponding to the respective protrusions provided on the front surface of the turbine disk to fix a plurality of turbine blades to the turbine disk, the plurality of turbine blades disposed in the respective dovetail grooves of the turbine disk body and each having a second insert slot in a surface of the turbine blade that faces the first insert slot;

a second retainer unit having a first end thereof disposed in the first insert slot and a second end thereof disposed in the second insert slot to fix the plurality of turbine blades to the turbine disk at the rear surface of the turbine disk; and a plurality of fixing members provided to fix the first and second retainer units, wherein the protrusions comprise:

first protrusions protruding outwardly on the perimeter of the front surface of the turbine disk along a concentric circle centered on a center of the turbine disk; and second protrusions protruding outwardly on the perimeter of the rear surface of the turbine disk along a concentric circle centered on the center of the turbine disk, and wherein the plurality of fixing members comprises:

a first fixing member disposed on a front surface of the first retainer unit and fitted over the corresponding first protrusion to assist in fixing the first retainer unit; and a second fixing member disposed on a rear surface of the second retainer unit and fitted over the corresponding second protrusion to assist in fixing the second retainer unit.

13. The gas turbine according to claim 12, wherein the first fixing member comprises a second locking part configured to come in close contact with left and right side surfaces of the corresponding first protrusion and locked to an upper surface of the first protrusion, and wherein the second fixing member comprises a third locking part configured to come in close contact with left and right side surfaces of the corresponding protrusion and locked to an upper surface of the second protrusion.

14. An apparatus for fixing a plurality of turbine blades to a turbine disk, the plurality of turbine blades each having a first insert slot facing a second insert slot formed in a rear surface of the turbine disk in a circumferential direction, comprising:

a plurality of first protrusions provided on a front surface of the turbine disk and protruding outwardly from the front surface;

a first retainer unit having openings at positions corresponding to the respective first protrusions provided on the front surface of the turbine disk to fix the plurality of turbine blades to the turbine disk;

a second retainer unit having a first end thereof configured to be inserted into the first insert slot and a second end thereof configured to be inserted into the second insert slot to fix the plurality of turbine blades to the turbine disk at the rear surface of the turbine disk; and a plurality of fixing members to fix the first retainer unit and the second retainer unit to the turbine disk, wherein the first retainer unit including a plurality of first unit retainers, each of the plurality of the first unit retainers including a first end of the first unit retainer having a first locking part to be closely locked to a disk protrusion protruding outward along a perimeter of the front surface of the turbine disk, and a second end of the first unit retainer to come in close contact with a front surface of the corresponding turbine blade.

15. The apparatus of claim 14, further comprising:

a plurality of second protrusions provided on a rear surface of the turbine disk and protruding outwardly from the rear surface, wherein the second retainer unit includes a plurality of second unit retainers, each of the second unit retainers including a second retainer body having a plate shape, and fitting depressions formed in left and right sides of the second retainer body at positions facing away from each other to be fitted over a corresponding second protrusion.

16. The apparatus of claim 15, wherein the second retainer body includes:

a first stepped part formed at a left side edge of the second retainer body at which one of the fitting depressions is formed, and a second stepped part formed at a right side edge of the second retainer body at which the other fitting depression is formed to receive the first stepped part of another second retainer body.

17. The apparatus of claim 14, wherein the plurality of fixing members includes a first fixing member configured to engage the first retainer unit when fitted over the first protrusion protruding from a corresponding opening to assist in fixing the first retainer unit to the turbine disk.

18. The apparatus of claim 15, wherein the plurality of fixing members includes a second fixing member configured to engage the second retainer unit when fitted over the second protrusion protruding from a corresponding fitting depression to assist in fixing the second retainer unit to the turbine disk.

* * * * *